US011103037B2

(12) United States Patent
Barken

(10) Patent No.: US 11,103,037 B2
(45) Date of Patent: Aug. 31, 2021

(54) WATCH ANTI-THEFT DEVICE AND WATCH STRAP COMBINATION, AND A DEVICE FOR THE COMBINATION

(71) Applicant: LUXWI APS, Gentofte (DK)

(72) Inventor: Bo Barken, Frederiksberg (DK)

(73) Assignee: LUXWI APS, Gentofte (DK)

( * ) Notice: Subject to any disclaimer, the term of this patent is extended or adjusted under 35 U.S.C. 154(b) by 0 days.

(21) Appl. No.: 16/982,488

(22) PCT Filed: Mar. 14, 2019

(86) PCT No.: PCT/EP2019/056432
§ 371 (c)(1),
(2) Date: Sep. 18, 2020

(87) PCT Pub. No.: WO2019/179877
PCT Pub. Date: Sep. 26, 2019

(65) Prior Publication Data

US 2021/0045505 A1 Feb. 18, 2021

(30) Foreign Application Priority Data

Mar. 21, 2018 (DK) ..... PA 2018 70181

(51) Int. Cl.
*A44C 19/00* (2006.01)

(52) U.S. Cl.
CPC ..... *A44C 19/00* (2013.01)

(58) Field of Classification Search
CPC ..... A44C 19/00; Y10T 24/10; Y10T 24/4782; Y10T 24/13; Y10T 24/14; Y10T 24/1402;
(Continued)

(56) References Cited

U.S. PATENT DOCUMENTS 734,110 A * 7/1903 Dulin ..... B65D 63/10 24/17 R
2,041,944 A 5/1936 Mestekin
(Continued)

FOREIGN PATENT DOCUMENTS

CH 666 165 A5 7/1988
DE 9002848 U1 10/1990
(Continued)

OTHER PUBLICATIONS

International Search Report and Written Opinion received in PCT Application No. PCT/EP2019/056432, dated Jun. 4, 2019.
(Continued)

*Primary Examiner* — Jack W Lavinder
(74) *Attorney, Agent, or Firm* — McDermott Will & Emery LLP

(57) ABSTRACT

The invention relates to the combination of a watch strap (S) and an anti-theft security device (10), said watch strap (S) including a watch band comprising two parts (1', 1"), each part (1', 1") having at one end (5, 6) connection means for attachment to the casing of a watch, the other end of each of said parts (1', 1") being attached to a clasp (8, 8') of the type that opens and folds out upon a manual prying force being applied to a portion (9) thereof, to allow for said watch strap (S) to be removed from the arm of a person, said anti-theft device (10) including an elongated, back-foldable middle portion (20) and respective end portions (30, 40), said end portions (30, 40) having complementary means/structures for releasably engaging each other to define a closed configuration of the device (10) wherein said middle portion (20) at least partially encloses said clasp (8, 8').

15 Claims, 4 Drawing Sheets

(58) Field of Classification Search
CPC ..... A44B 11/006; A44B 11/008; A44B 11/22; A44B 11/2557; A44B 11/2553; A44B 11/2561; A44B 11/28
USPC ..... 63/1.18; 368/281, 282
See application file for complete search history.

(56) References Cited

U.S. PATENT DOCUMENTS

| | | | | |
|---|---|---|---|---|
| 5,699,590 | A | 12/1997 | Erard | |
| 8,904,820 | B2 * | 12/2014 | Chen | A44C 13/00 63/1.12 |
| 10,842,235 | B2 * | 11/2020 | Buonomo | A44C 5/24 |
| 2011/0016672 | A1 * | 1/2011 | Mancini | A61M 5/1418 24/16 R |
| 2015/0289608 | A1 * | 10/2015 | Rivera | A44C 5/14 368/282 |

FOREIGN PATENT DOCUMENTS

| | | | | |
|---|---|---|---|---|
| DE | 201 03 162 | U1 | 6/2001 | |
| DE | 102016011576 | A1 | 3/2018 | |
| EP | 1072207 | A1 * | 1/2001 | A44B 11/008 |
| EP | 2810588 | A1 | 10/2014 | |
| GB | 2268217 | A | 1/1994 | |
| JP | S58-35047 | Y2 | 8/1983 | |
| WO | 2016-170524 | A1 | 10/2016 | |

OTHER PUBLICATIONS

DK Patent Office—Search Report dated Sep. 26, 2018 for priority application No. PA 2018 70181, 4 pgs.
EPO—International Preliminary Report on Patentability mailed by International Bureau in related International Application No. PCT/EP2019/056432, dated Oct. 1, 2020; 8 pgs.
Indian Patent Office, Office Action for related Indian Patent Application No. 202, 047045545, dated May 28, 2021, 5 pgs.

* cited by examiner

FIG. 1D
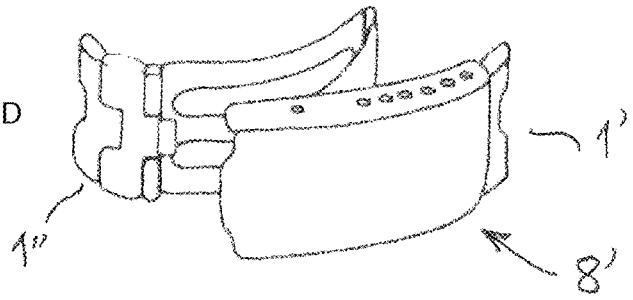
FIG. 2
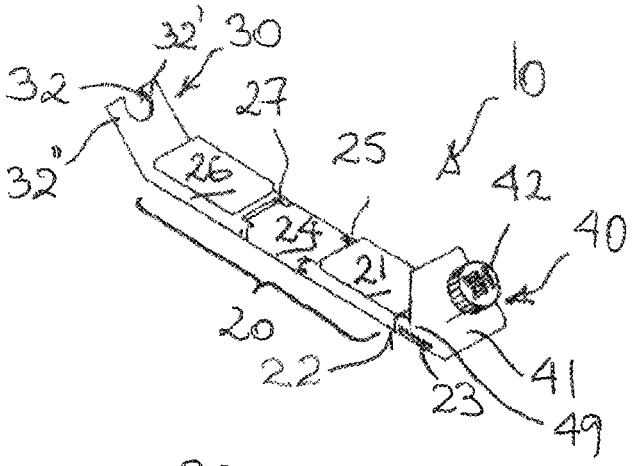
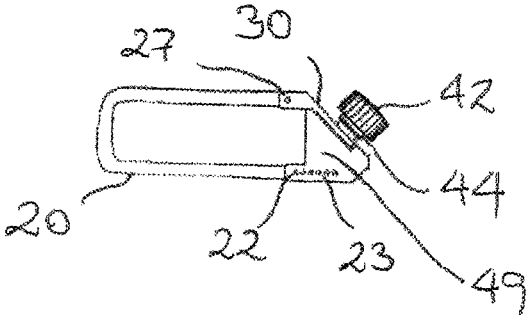
FIG. 3A
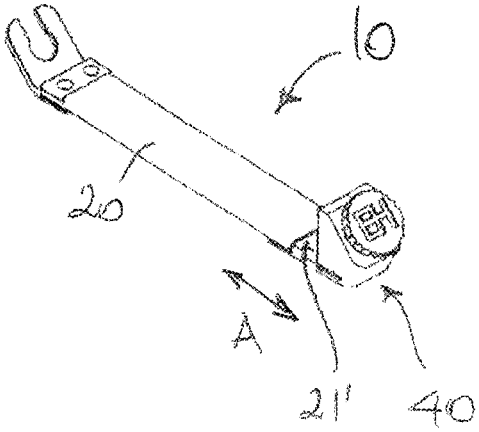
FIG. 3B

WATCH ANTI-THEFT DEVICE AND WATCH STRAP COMBINATION, AND A DEVICE FOR THE COMBINATION

CROSS-REFERENCE OF RELATED APPLICATIONS

This application is the U.S. National Phase under 35 U.S.C. § 371 of International Patent Application No. PCT/EP2019/056432, filed on Mar. 14, 2019, which in turn claims the benefit of Denmark Patent Application No. PA201870181, filed on Mar. 21, 2018 the entire disclosures of which Applications are incorporated by reference herein for all purposes.

The present invention relates generally to a device for preventing theft or other loss of a wrist watch from a person wearing the watch.

BACKGROUND OF THE INVENTION

Wrist watches vary greatly in value, from high-end watches that may carry a retail price of $100,000 or even more to low-end watches carrying a retail price in the order of a few dollars. Typically the watch strap includes a watch band comprising two parts where each part has at one end connection means for attachment to the casing of the watch, and with i) a clasp of the buckle type including a pin inserted into watch band holes, the clasp being connected to the other end of one of the parts allowing the two parts to be connected, or with ii) the other end of each of the two parts being attached to a clasp of the type that opens and folds out upon a manual prying force being applied to a portion thereof, to allow for the watch strap to be removed from the arm of the person wearing the watch. The latter clasps are typically of the butterfly type, or of the fold-over type, whereby opening the clasp expands the watch strap.

Thieves have specialised in stealing high-end wrist watches when they are being worn. Often this is done while distracting the wearer and using stealth, applying a prying force to open the clasp to undetected remove the watch strap with the expensive watch. It is a problem that modern watch straps are not sufficient secured against theft.

SUMMARY OF THE INVENTION

The present invention aims at solving the aforementioned problem, and this by the combination defined in claim 1. Embodiments of the invention are defined in the dependent claims. In one embodiment a middle portion of the anti-theft device is composed of three segments wherein a central segment thereof is pivotally linked by respective pins to a respective neighbouring one of the remaining two segments; the segments may all be made of metal, or some of the segments, such as the central segment and the segment connected to a body defining a first end portion of the device may be made of a soft and flexible material, such as an elastomeric material, allowing for the device to adapt to different sizes of the watch band.

BRIEF DESCRIPTION OF THE DRAWINGS

Embodiments of the present invention will now be discussed by reference to the appended drawings wherein FIG. 1*d* shows a perspective view of a clasp of the fold over type that may be part of the watch strap, FIG. 2 is a perspective view of the security device of FIGS. 1*a*-1*c*, FIGS. 3*a* and 3*b* is a side view and perspective view, respectively, of another embodiment of the security device of the invention.

FIGS. 1*a* and 1*b* show generally a watch strap S including a watch band comprising two elongated leather or stretchable material parts 1', 1", each part 1', 1" having at one end 5, 6 connection means (not shown) for attachment to the casing of a watch (also not shown). Another end of each of the parts 1', 1" is attached to a metal clasp 8 of the fold-out type, i.e. of the type that opens and folds out upon a manual prying force being applied to a portion 9 thereof, to allow for the watch strap S with the watch (now shown) to be removed from the arm of a person wearing the watch. Also shown is a security device 10 according to the present invention, mounted in its active configuration around the watch strap S at the clasp 8 and to be discussed further below.

In FIGS. 1*a* and 1*b* the watch strap S clasp 8 is illustrated in its closed position in which the watch strap S is tightened around the arm of the person wearing the watch; the shown clasp 8 is of the butterfly type but any other type of clasp 8, such as the fold out/fold over clasp 8' shown in FIG. 1*d* may be used with the present invention. FIG. 1*c* is a side view of the watch strap S, illustrating the security device 10 extending in its active or closed configuration around the watch strap S at the position of the clasp 8.

It is noted that the watch band may alternatively, without departing from the present invention, be of the segmented metal type having two parts 1', 1" that each comprise pivotally interconnected metal links, of which one link at a respective end of the two watch band parts 1', 1" is connected to the clasp 8', as shown in FIG. 1*d*.

Figure 1A:
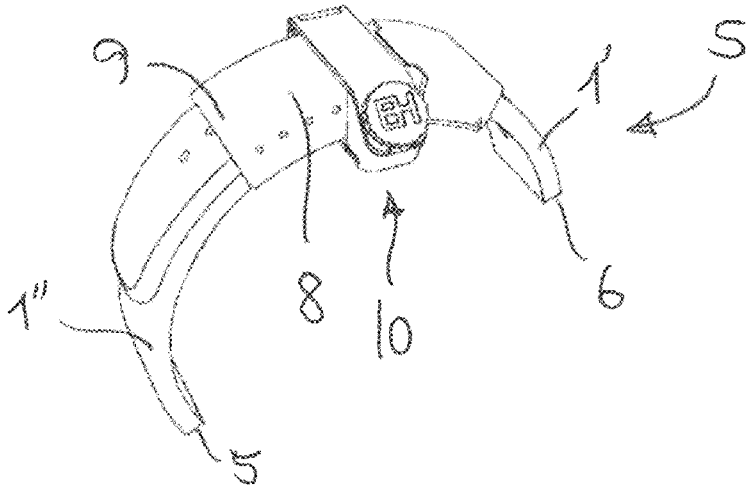
FIGS. 1*a*-1*c* show the combination of a watch strap carrying a first embodiment of the security device of the invention, seen in closed and open configurations, in perspective views and in a side view.
Figure 1B:
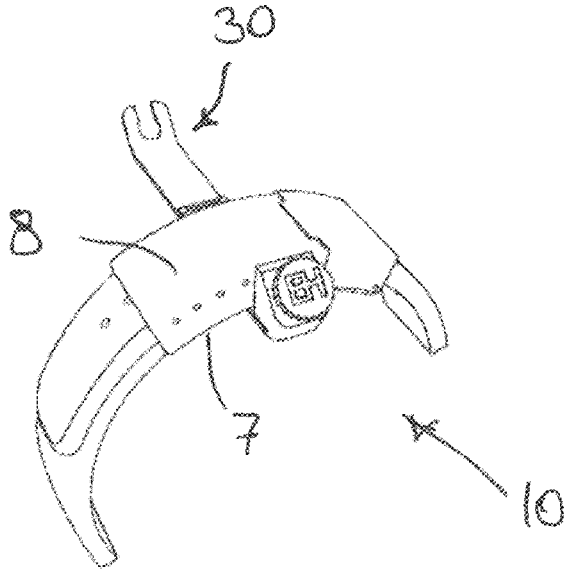

Turning now to FIG. 1*b* shown is the anti-theft security device 10 of the present invention wherein a wearer of the watch strap S has first closed the clasp 8 and then inserted a slim middle portion of the device 10 in its inactive or open configuration into the narrow gap between his arm (not shown) and the lower face 7 of the clasp 8. The wearer of the watch strap S then brings the security device 10 into its active or closed configuration shown in FIGS. 1*a* and 1*c* and locks the security device 10 in its closed configuration, whereby any folding out of the clasp 8 and, hence, attempts to remove the watch from the arm of the wearer, is prevented in that any prying force applied on portion 9 is resisted by the security device 10 extending around the clasp 8.

Figure 1C:
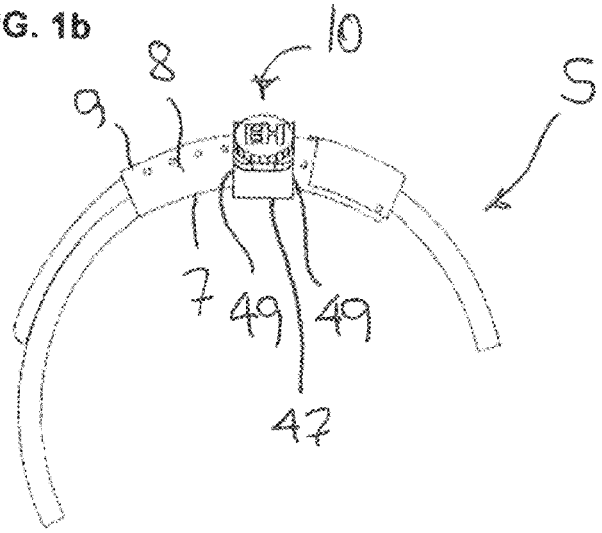

Turning now to FIG. 2 the embodiment of the security device 10 of FIGS. 1*a*-1*c* is shown in its inactive open configuration ready for deployment. The device 10 generally includes a metal middle portion 20 and respective end portions 30, 40. The first end portion 40 includes a metal body 41 and a screw with a screw head 42 having a threaded stem screwed into the body 41. Two opposite metal body 41 side walls 49 delimit a rearwardly open, i.e. opening out in a direction facing away from the screw head 42, recess positioned close to the base 47 of the body 41.

As may be understood from eg. FIG. 1*a*, bringing the device 10 into the closed configuration generally involves a back-folding or doubling of the middle portion 20.

A fork-like structure 32 with two opposite prongs 32', 32" is formed in a metal structure defining the second end portion 30. For the shown embodiment the middle portion 20 is composed of three segments 21, 24, 26 wherein a central segment 24 is pivotally linked by respective pins 25, 27 to a respective neighbouring one of the remaining two segments 21, 26. Further, one segment 21 of the remaining two segments 21, 26 connected to the central segment 24 is connected to the metal body 41 via a connector portion 21' using a pin 23 received in a pair of a plurality of opposite apertures 22 formed in the two opposite metal body 41 side walls 49 delimiting the aforementioned rearwardly open recess. In FIG. 2 the connecting pin 23 is received in two opposite apertures 22 closest to the screw head 42; release and subsequent reinsertion of the pin 23 into another pair of opposite apertures 22 allows for adjustment of the distance between the body 41 and the second end 30 by pulling out the connector portion 21' (see FIG. 3*b*) of segment 21 from within the aforementioned recess. Shown in FIG. 2 are also optional cushioning layers defining surfaces of two of the segments 21, 26 and made of any soft material, such as an elastomeric material, bearing against the clasp 8 in the closed configuration of the security device 10.

In use of the device 10, after having inserted the middle portion 20 in the narrow gap between his/her arm and the lower face 7 of the closed clasp 8, 8', the user closes the device 10 through back-folding, i.e. involving a turning of the segments 21, 24, 26 relative to one another around the respective pivot axes defined by the pins 25, 27 and by positioning the two prongs 32', 32" of the fork-like structure 32 on a respective side of the threaded stem of screw head 42. The security device 10 now assumes the configuration shown in FIGS. 1*a* and 1*c* at which time the user will tighten the screw by manually turning screw head 42 until it sits tightly against the face of the end portion 30 at the fork-like structure 32, to thereby lock the device 10 in the closed configuration.

Referring now to FIGS. 3*a* and 3*b* shown is an alternative embodiment wherein the middle portion 20 of the security device is defined by a flexible material, such as leather or a synthetic material which may be elastically stretchable. Preferably, for this embodiment the middle portion 20 is again connected to the body 41 by a pin 23 received in two corresponding opposite apertures 22 formed in the body 41, allowing for the aforementioned adjustment in the direction marked by arrows A by varying the degree to which the aforementioned connector portion, shown by numeral 21', is received within the recess formed in the body 41. Closing of the device 10 is carried out in the manner explained above, namely by back-folding the middle portion 20, receiving the screw stem 44 between the prongs 32', 32" of the fork-like structure 32 and turning screw head 42 until it sits tightly against the face of the fork-like structure 32; back-folding is by simply bending the flexible material middle portion 20.

Figure 4:
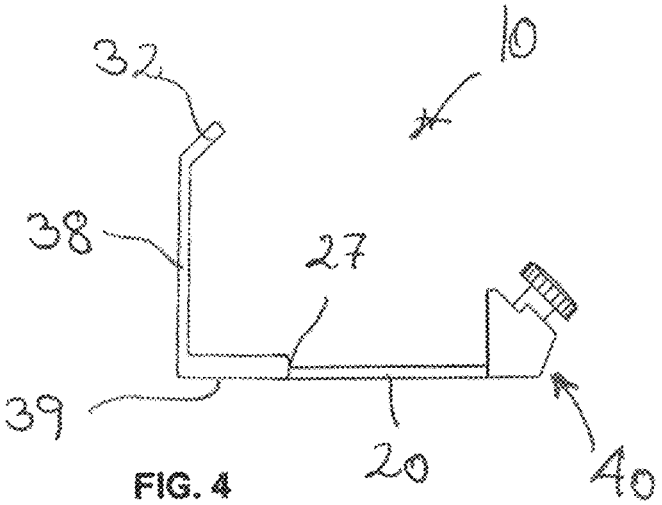
FIG. 4 is a side view of a third embodiment of the security device of the invention.

Finally, FIG. 4 shows yet another embodiment of the invention wherein the end portion 30 with the fork-like structure 32 includes two integrally connected legs 38, 39 extending at angle to one another, here shown as extending perpendicularly to one another, and being pivotally connected to middle portion 20 via pin 27, which middle portion 20 may be integrally or pivotally or otherwise connected to body 41.

While in the foregoing the locking of the security device 10 is described in relation to a mechanism where a female portion, i.e. the fork-like structure 32 receives a male portion in the form of the screw stem 44 after which the screw is tightened for locking the device 10, an alternative solution may be envisaged wherein the locking of the device 10 in the closed configuration is through a snap action in that two complementary and releasably snap-engageable structures are configured at a respective end portion 30, 40 of the device 10 to provide a snap engaging lock, in lieu of the prong/stem combination discussed above.

It will be understood from the above that removal of the watch from the wearers arm is made more difficult in requiring—in addition to the prying force for the opening of the clasp 8, 8'—a further release of the security device 10, bringing it to the open configuration shown in FIG. 1*b*. Moreover, displacement of the security device 10 along the length of the clasp 8, 8' is prevented or restricted by the clamping force of the device 10 against the clasp 8, 8' arising from the turning of the screw head towards the portion 30, or—where a snap lock mechanism is used—by the snap engagement forces, possibly further enhanced by friction provided by the aforementioned cushioning layers. The embodiment of the device shown in FIGS. 3*a* and 3*b* may be accommodate for different thicknesses as well as for different widths of the clasp 8 while the embodiment of FIG. 2 may accommodate for slight width variations, the dimension of the segment 24 determining to a large degree the thickness of the clasp 8 with which the device 10 may be used.

Figure 5:
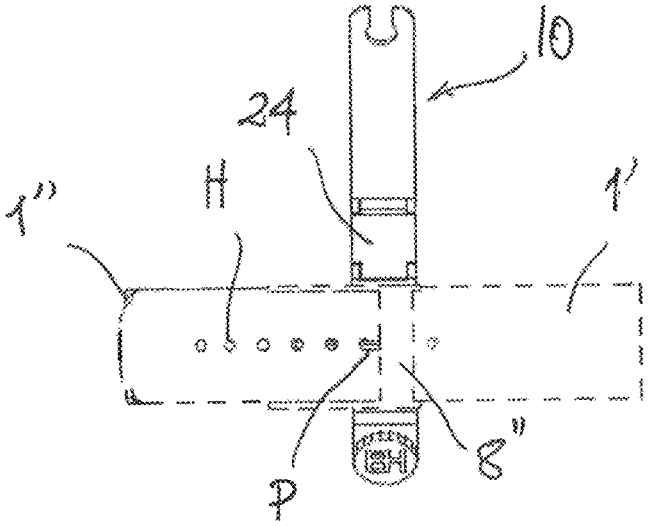
FIG. 5 is a top view of the device shown in FIG. 2 with a watch strap including a clasp of the buckle type where a pin is inserted into watch band holes.

FIG. 5 is a top view of the device 10 shown in FIG. 2 used in connection with a watch strap S including a clasp 8" of the buckle type where a pin P is inserted into watch band holes H.

Figure 6:
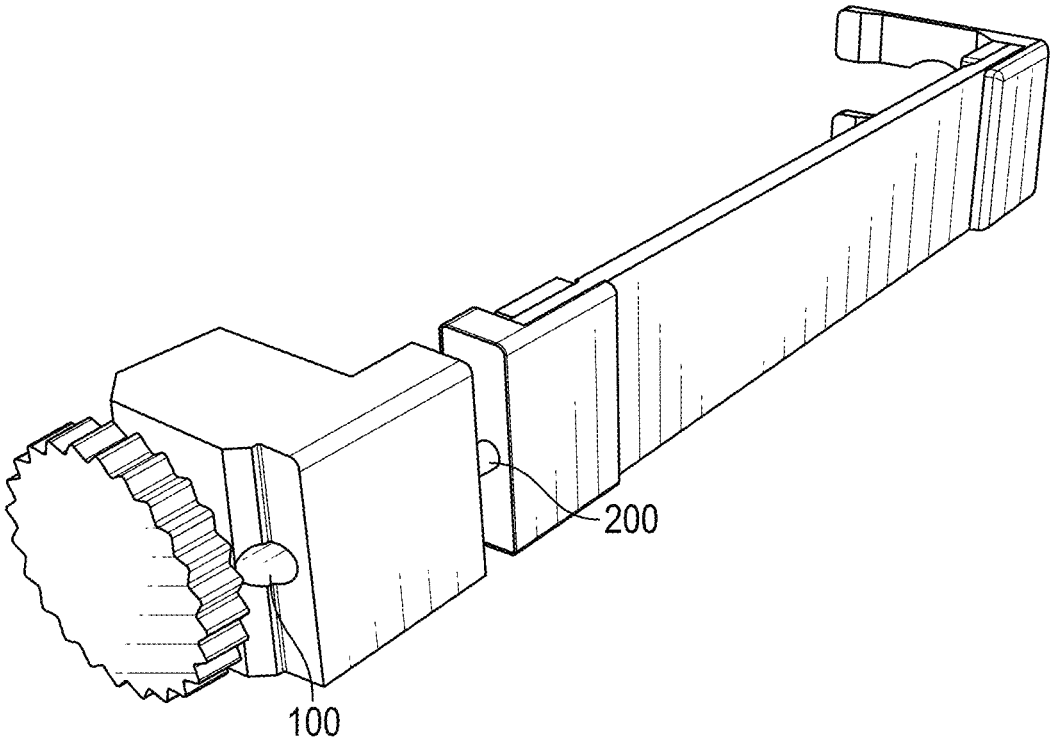
FIG. 6 shows an embodiment with an alternative adjustment mechanism.

FIG. 6 shows an alternative mechanism for the above mentioned adjustment, where an aperture 100 formed in body 41 provides screwdriver access to a screw 200 connecting the body 41 to middle portion 20, wherein correct rotation of the screw 200 may approach the body 41 to the middle portion 20 for said adjustment.

The invention claimed is:

1. The combination of a watch strap and an anti-theft security device, said watch strap including:

-a watch band comprising two parts, each part having, at a first end, a connection for attachment to a casing of a watch, and i) a clasp of a buckle type including a pin insertable into holes of a first one of said parts, the clasp being connected to a second end of a second one of said two parts, to allow the two parts to be connected with each other, or ii) a second end of each of said parts being attached to a clasp of a type that opens and folds out, such as upon a manual prying force being applied to a portion thereof, to allow for said watch strap to be removed from an arm of a person, wherein:

said anti-theft security device includes an elongated, back-foldable middle portion and a first and second end portions, said end portions having complementary structures configured for releasably engaging each other to define when engaged, a closed configuration of the anti-theft security device wherein said anti-theft security device encloses said clasp, said first end portion including a body and a screw with a screw head having a threaded stem screwed into said body, a structure defining said second end portion including two prongs configured for receiving therebetween said stem, wherein turning said screw head advances said screw head to directly or indirectly sit tightly against said first end portion for locking said security device in position around said watch strap, and a distance between said body and the second end portion is adjustable.

2. The combination of claim 1, said complementary structures engaging each other by snap action.

3. The combination of claim 1, wherein said back-foldable middle portion being composed of three segments wherein a central segment thereof is pivotally linked by respective pins to a respective neighbouring one of the remaining two segments.

4. The combination of claim 1, wherein said two parts of said watch band comprise a flexible, stretchable material.

5. The combination of claim 1, said watch band comprising pivotally connected links.

6. An anti-theft security device for a combination according to claim 1, the anti-theft security device including a relatively flat elongated, back-foldable middle portion and respective end portions, said end portions having complementary structures for releasably engaging each other to define a closed configuration of the device by a snap engagement, said body including two opposite side walls delimiting a rearwardly open recess, a plurality of pairs of opposite apertures formed in said side walls receiving a connecting pin connected to a connector portion of said middle portion and connecting said middle portion to said body, said connector portion being received in said recess.

7. The device of claim 6, said middle portion being composed of three segments wherein a central segment thereof is pivotally linked by respective pins to a respective neighbouring one of the remaining two segments.

8. The combination of a watch strap and an anti-theft security device, said watch strap including:

-a watch band comprising two parts, each part having at a first end a connection for attachment to a casing of a watch, and i) a clasp of a buckle type including a pin insertable into holes of a first one of said parts, the clasp being connected to a second end of a second one of said two parts, to allow the two parts to be connected with each other, or ii) a second end of each of said parts being attached to a clasp of a type that opens and folds out, such as upon a manual prying force being applied to a portion thereof, to allow for said watch strap to be removed from an arm of a person, wherein:

said anti-theft security device including an elongated, back-foldable middle portion and first and second end portions, said end portions having complementary structures configured for releasably engaging each other to define when engaged, a closed configuration of the anti-theft security device wherein said anti-theft security device encloses said clasp, said first end portion including a body, two opposite side walls of said body delimiting a rearwardly open recess, a plurality of pairs of opposite apertures formed in said side walls receiving a connecting pin connected to a connector portion of said middle portion and connecting said middle portion to said body, said connector portion being received in said recess, and a distance between said body and the second end portion is adjustable.

9. An anti-theft security device for a combination according to claim 8, including a relatively flat elongated, back-foldable middle portion and respective end portions, said end portions having complementary structures for releasably engaging each other to define a closed configuration of the device by a first end portion including a metal body, and a screw with a screw head having a threaded stem screwed into said body, two opposite prongs being formed in a structure defining a second end portion, said two prongs being configured for receiving therebetween said stem, wherein turning said screw head advances said screw head to directly or indirectly sit tightly against said first end portion for said releasable engagement.

10. The device of claim 9, said metal body including two opposite side walls delimiting a rearwardly open recess, a plurality of pairs of opposite apertures formed in said side walls receiving a connecting pin connected to a connector portion of said middle portion and connecting said middle portion to said body, said connector portion being received in said recess.

11. The device of claim 9, said back-foldable middle portion being composed of three segments wherein a central segment thereof is pivotally linked by respective pins to a respective neighbouring one of the remaining two segments.

12. The combination of claim 8, said complementary structures engaging each other by snap action.

13. The combination of claim 8, wherein said back-foldable middle portion is composed of three segments wherein a central segment thereof is pivotally linked by respective pins to a respective neighbouring one of the remaining two segments.

14. The combination of claim 8, wherein said two parts of said watch band comprise a flexible, stretchable material.

15. The combination of claim 8, said watch band comprising pivotally connected links.

* * * * *